US008540170B2

(12) United States Patent
Jaeger

(10) Patent No.: US 8,540,170 B2
(45) Date of Patent: Sep. 24, 2013

(54) ROTOR NOZZLE

(76) Inventor: Anton Jaeger, Senden (DE)

( * ) Notice: Subject to any disclaimer, the term of this patent is extended or adjusted under 35 U.S.C. 154(b) by 604 days.

(21) Appl. No.: 12/774,975

(22) Filed: May 6, 2010

(65) Prior Publication Data

US 2010/0282864 A1 Nov. 11, 2010

(30) Foreign Application Priority Data

May 8, 2009 (DE) ..... 10 2009 020 409

(51) Int. Cl.
*B05B 3/04* (2006.01)

(52) U.S. Cl.
USPC ..... 239/237; 239/225.1; 239/240; 239/263; 239/380

(58) Field of Classification Search
USPC ..... 239/225.1, 237, 240, 251, 263, 264, 239/380, 381
See application file for complete search history.

(56) References Cited

U.S. PATENT DOCUMENTS

| | | | | |
|---|---|---|---|---|
| 5,332,155 | A * | 7/1994 | Jager | 239/240 |
| 5,395,053 | A * | 3/1995 | Frech | 239/237 |
| 6,736,333 | B2 * | 5/2004 | Binder et al. | 239/225.1 |
| 7,118,051 | B1 * | 10/2006 | Jager | 239/381 |

FOREIGN PATENT DOCUMENTS

| | | | |
|---|---|---|---|
| DE | 39 02 478 | C1 | 7/1990 |
| DE | 40 13 446 | C1 | 5/1991 |
| DE | 41 33 973 | A1 | 4/1992 |
| DE | 44 33 646 | A1 | 3/1995 |
| DE | 44 33 646 | C2 | 3/1995 |
| DE | 19742420 | A1 | 4/1999 |
| DE | 198 20 238 | A1 | 11/1999 |
| DE | 100 46 351 | A1 | 3/2002 |
| EP | 0 393 689 | A1 | 10/1990 |

(Continued)

OTHER PUBLICATIONS

European Search Report dated Dec. 14, 2010 EP 10004818.0.

(Continued)

*Primary Examiner* — Steven J Ganey
(74) *Attorney, Agent, or Firm* — Gifford, Krass, Sprinkle, Anderson & Citkowski, P.C.

(57) ABSTRACT

The invention relates to a rotor nozzle, in particular for high-pressure cleaning devices, having a nozzle housing which has an inlet opening at its axially one end and an outlet opening at the other end for a fluid, in particular water, as well as having a rotor which is arranged in a swirl chamber of the nozzle housing, which is supported at a bearing at its front end facing the outlet opening, which can be at least partly flowed through by the fluid, which can be set into rotation about a longitudinal axis of the nozzle housing by fluid flowing into the swirl chamber and is inclined toward the longitudinal axis at least in the rotated state. Provision is made in this respect that a flexing device is arranged in the swirl chamber which surrounds the rotor and at which deformation work is carried out in a flexing state given from a specific inclination angle of the rotor onward, wherein up to a specific angle of inclination of the rotor the flexing device adopts a base state in which the flexing device is arranged at a spacing from an end abutment and/or wherein the spacing is changeable in the flexing state by deformation of the flexing device: and or that the nozzle housing has a front assembly opening through which an assembly including a plurality of components can be introduced into a nozzle housing and removed from the nozzle housing as a unit.

42 Claims, 5 Drawing Sheets

(56) References Cited

FOREIGN PATENT DOCUMENTS

Figure 1:
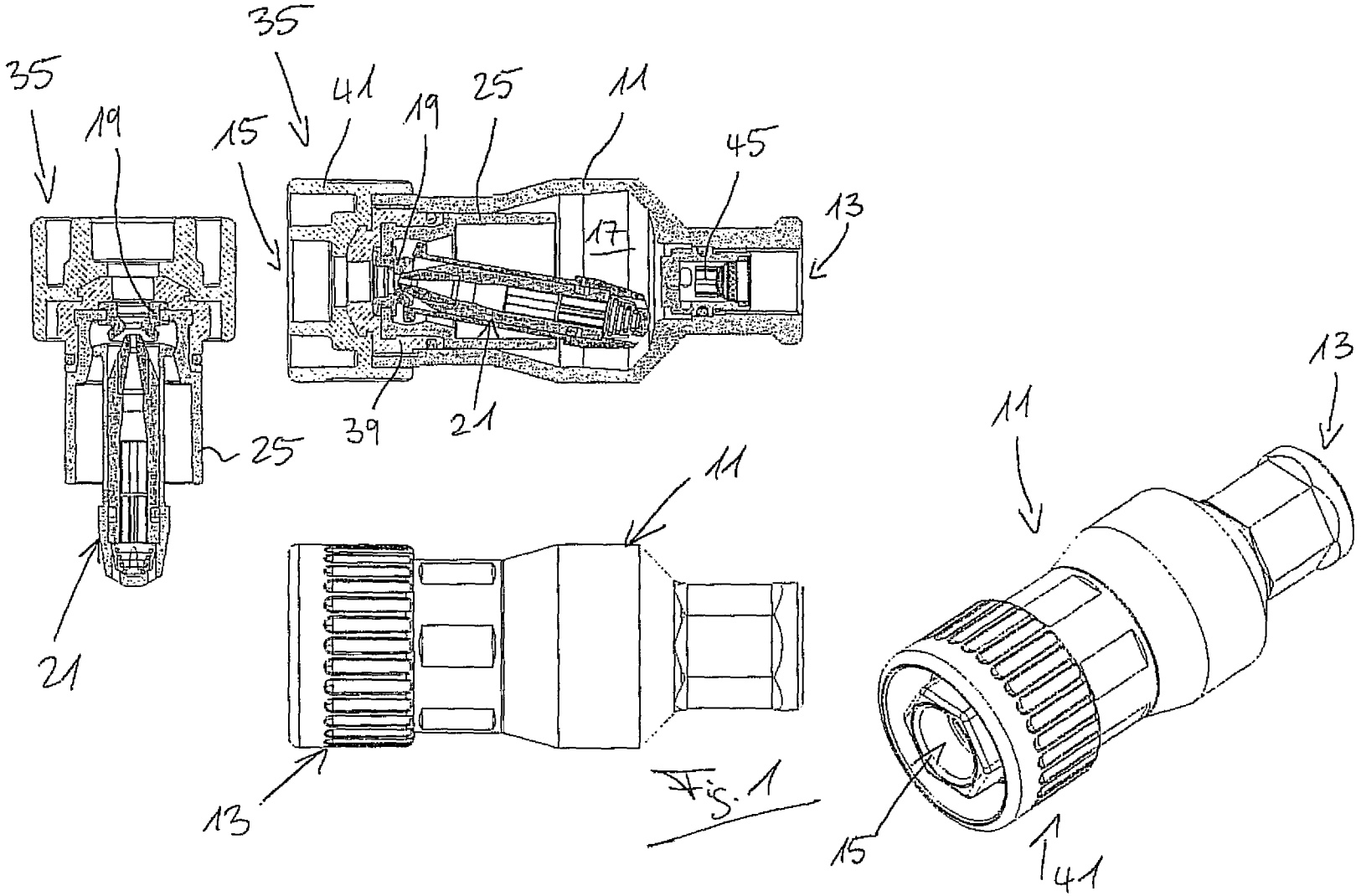

| | | | |
|---|---|---|---|
| EP | 0 891 816 | A2 | 1/1999 |
| EP | 0 891 816 | B1 | 1/1999 |
| EP | 0 931 594 | A2 | 7/1999 |
| EP | 0 931 594 | B1 | 7/1999 |
| JP | 05 123613 | | 5/1993 |

OTHER PUBLICATIONS

German Search Report dated May 4, 2010. German Patent Application No. 10 2009 020 409.1.

* cited by examiner

ROTOR NOZZLE

CROSS-REFERENCE TO RELATED APPLICATIONS

This application claims priority of German Patent Application No. DE 10 2009 020 409.1 filed May 8, 2009.

The invention relates to a rotor nozzle, in particular for high-pressure cleaning devices, having a nozzle housing which has an inlet opening at its axially one end and an outlet opening at the other end for a fluid, in particular water, as well as having a rotor which is arranged in a swirl chamber of the nozzle housing, which is supported at a bearing at its front end facing the outlet opening, which can be at least partly flowed through by the fluid and which can be set into rotation about a longitudinal axis of the nozzle housing by fluid flowing into the swirl chamber and is inclined toward the longitudinal axis at least in the rotated state, with a flexing device being arranged in the swirl chamber which surrounds the rotor and at which deformation work is carried out in a flexing state given from a specific inclination angle of the rotor onward.

Rotor nozzles of this type are generally known. Reference is made for this purpose, for example, to auf DE 39 02 478 C1, DE 40 13 446 C1, DE 41 33 973 A1, DE 44 33 646 C2 and EP 0 891 816 B1. It is thus known, for example, either to provide the rotor with an elastically deformable rolling ring or to provide the inner side of the housing with an elastically deformable ring region, i.e. to provide a part of the housing interior with e.g. a rubber coating. As soon as the rotor exceeds a specific angle of inclination relative to the longitudinal axis of the nozzle housing during its rotation due to the flow present in the swirl chamber, the rotor comes into contact with the inner wall of the nozzle housing, whereby either the rolling ring of the rotor or the rolling region of the inner wall of the nozzle housing is elastically deformed. Deformation work is hereby carried out at the rolling ring or at the elastically deformable housing wall. This has the consequence that the rotational speed of the rotor about the longitudinal axis of the nozzle housing is reduced. In this manner a smoothing of the running of the rotor is achieved and a better spray pattern is produced overall.

It is the object of the invention to improve a rotor nozzle of the initially named kind even further in the sense of a smoothing of the running of the rotor and of an optimization of the spray pattern.

This object is satisfied by the features of claim 1.

Provision is in particular made that, up to a specific angle of inclination of the rotor, the flexing device adopts a base state in which the flexing device is arranged at a spacing from an end abutment and that the spacing is changeable in the flexing state by deformation of the flexing device.

It has been found that with the rotor nozzles known from the prior art an improvement of the running properties of the rotor s well as an improvement of the spray pattern can admittedly be achieved by the flexing device provided in the form of the rolling ring or of the deformable inner wall of the nozzle housing, but that the actually carried out deformation work only plays a more subordinate role in the interaction between the rotor and the nozzle housing. The cooperation of the rotor and of the nozzle housing is rather characterized by friction effects, i.e. the rotor circulating about the longitudinal axis of the nozzle housing slips or slides over the inner wall of the nozzle housing rather than rolling off it. It has been found in this respect that the degree of deformation of the rolling ring or of the "rolling coating" provided at the inner wall of the nozzle housing has a large dependence on the weight of the rotor.

It was recognized as the cause for this running behavior of the rotor and the spray pattern of the rotor nozzle resulting therefrom that the deformation work which can be carried out is dependent on the degree to which the rolling ring or the rolling coating can be compressed, for more than the relative movement between the rotor and the inner wall of the nozzle housing which can be achieved by compression of the rolling ring or of the rolling coating is not available.

In accordance with the invention, the deformation work is put into the foreground in that a larger path distance is provided than can be provided by mere compression of an elastically deformable material. Provision is in particular made in accordance with the invention that, deviating from the initially named prior art, the flexing device is arranged at a spacing from an end abutment so that a path distance is available between the flexing device and the end abutment. This spacing makes it possible to deform the flexing device in the flexing state to a much larger degree than is possible by mere compression of the material forming the flexing device.

Experiments have shown that the rotor turns a lot more evenly and a considerably improved spray pattern results by this measure in accordance with the invention. It was further observed that the oscillation behavior of the rotor nozzle as a whole is improved since oscillation forming effects or natural oscillation effects such as are observed in known rotor nozzles do not occur at all or occur to a substantially reduced degree. The handling of the rotor nozzle is hereby noticeably improved for the user.

These positive effects of the measure in accordance with the invention can be explained in that a decoupling is provided between the rotor and the nozzle housing by the spacing of the flexing device from the end abutment which can be formed, for example, either by the rotor or by the inner wall of the nozzle housing. At the same time, the speed spectrum for the rotor can be improved by the path available for the deformation of the flexing device and a higher variability in the design and in particular in the fixing of the running behavior of the rotor can be achieved overall.

These advantages result in that the flexing device cannot only merely be compressed, but can be "fully flexed " in the true sense of the word. The deformation of the flexing device which occurs in the flexing state can be considered so-to-say as a "wave" of high amplitude which is propagated by the flexing device in accordance with the speed of the rotor, i.e. circulates in the flexing device about the longitudinal axis of the rotor nozzle or about the center axis of the rotor.

Advantageous embodiments of the invention are also set forth in the dependent claims, in the description and in the drawing. Some aspects of the rotor nozzle are such aspects which are independent of the design of the rotor nozzle set forth in claim 1, in particular of the flexing device, and for which protection is claimed independently. Special reference will be made to these aspects in the following.

It is preferred if the deformation of the flexing device includes a local movement of the material forming the flexing device in the direction of the end abutment, with the amount of the movement being larger than the thickness of the moved material of the flexing device.

It is further preferred if the flexing device is made such that the deformation of the flexing device takes place at least substantially without a pressing together or compression of the material of the flexing device due to the spacing from the end abutment.

As already initially mentioned, the end abutment can be formed by the inner wall of the nozzle housing or by the rotor, with a combination of these two possibilities also being conceivable. The flexing device can be arranged in a fixed position with respect to the nozzle housing. Alternatively, it is possible to attach the flexing device to the rotor so that the flexing device can be set into rotation together with the rotor. It must be mentioned for reasons of completeness that a combination of two single flexing devices is also conceivable of which the one is attached to the nozzle housing and the other to the rotor.

A flexing section of the flexing device arranged at a spacing from the end abutment in the base state can be provided which is made projecting, overhanging, jutting over, protruding and/or sticking out with respect to the nozzle housing. The deformability of the flexing device can in particular be given by the fact that a local bulging, deflection, impression, dimpling, bending, bending over, kinking and/or kinking over takes place.

It must generally be noted that the term "local" has the meaning here that, due to the fact that the deformation of the flexing device takes place with a rotor rotating about the longitudinal axis of the nozzle housing, the deformation of the flexing device does not take place over its total periphery, but rather only locally at that point which corresponds to the instantaneous angular position of the rotating rotor.

The flexing device can include a support region extending in the peripheral direction from which a deformable flexing section starts at which the deformation work is to be carried out, with the flexing device being in engagement or in contact with the nozzle housing or with the rotor.

The transition between the support region and the flexing section of the flexing device can in particular be disposed in the region of a peripheral edge at the inner wall of the nozzle housing so that, on a deformation of the flexing device, the flexing section is kinked over or bent over locally about this edge. The edge of the nozzle housing inner wall can in particular define the start of the flexing section.

Furthermore, at least one deformable flexing section of the flexing device at which the deformation work is to be carried out can be made as cylindrical, goblet-shaped, bell-shaped, funnel-shaped, conical or shell-shaped.

The flexing device can furthermore be arranged such that the flexing device extends in the base state at least with one deformable flexing section, at which the deforming work is to be carried out, at an angle to the longitudinal axis of the nozzle housing or to a center axis of the rotor. This angle can generally be selected as desired.

Provision is made in a further embodiment that the flexing device includes an assembly section with which the flexing device is attached to the nozzle housing or to the rotor.

The flexing device can be attached to the nozzle housing or to the rotor in a self-retaining manner, with the flexing device in particular being inserted into the nozzle housing or being placed onto the rotor.

In accordance with an independent aspect of a rotor nozzle, for which protection is also claimed independently here, the flexing device can form an assembly, together with at least one further component, which can be handled as a unit. This aspect in particular makes it possible that the assembly including the flexing device can be inserted into the nozzle housing and/or can be taken out of the nozzle housing as a unit. If one or more of these components has to be replaced, for example due to wear, this can take place in a particularly simple manner and in a very short time. This principle of an assembly of a plurality of components of the rotor nozzle which can be handled as a unit and which in particular include the rotor, is also claimed independently of whether a flexing device in accordance with the invention or a conventional flexing device of any design is provided or not.

The mentioned assembly can include the rotor, the bearing for the rotor and/or a front closure device of the rotor nozzle in addition to the flexing device.

In accordance with an independent aspect of a rotor nozzle which may be equipped with a flexing device, with this, however, not being compulsory and for which protection is also claimed independently here, the nozzle housing is provided with a front assembly opening which is closed in a fluid-tight manner by means of a closure device—with the exception of the outlet opening. In this manner, an access into the interior of the rotor nozzle is made possible from the front, which is in particular of advantage with respect to a simple and fast replacement of components arranged inside the rotor nozzle.

The named closure device can in particular be actuable in a tool-less manner.

Provision can furthermore be made that the closure device includes a front stopper which can be screwed to the nozzle housing, in particular into the nozzle housing. The front stopper is preferably actuable by means of a separate handle accessible from the outside for a user. The handle can in particular be a hand wheel or a hand screw.

Provision is furthermore preferably made in accordance with the invention that the flexing device holds the closure device and the bearing together. The flexing device can in particular be held together with the closure device, the bearing and/or the rotor by a latch connection, snap-in connection, hang-in connection or engagement connection.

Provision is furthermore preferably made that the rotor is held non-losably at the flexing device and is simultaneously held pivotable for the change of inclination.

In accordance with an independent aspect of a rotor nozzle having a flexing device, for which protection is also claimed independently here, provision is made that the flexing device is additionally made as a seal. It is hereby achieved in an advantageous manner that additional sealing measures such as O rings can be dispensed with wherever the flexing device itself can additionally take over a sealing function.

The flexing device is preferably made in one piece.

The flexing device can be made as a closed ring at least in a flexing section at which the deforming work is to be carried out.

The flexing section can be provided with openings, throughholes, slits, cut-outs and/or incisions. The deformation work actually to be carried out in the deformation of the flexing device can be directly preset by these measures so that there is a further possibility to influence the running behavior of the rotor and the spray pattern of the rotor nozzle.

The flexing device is preferably made from an elastically deformable material, for example from rubber. The flexing device can in particular be made from a material whose hardness is in the range from 30 to 90 Shore A hardness.

In accordance with an independent aspect of a rotor nozzle, which can be provided with a flexing device, with this, however, not being compulsory, and with protection being claimed for said aspect independently, the rotor is provided at its rear end with a plurality of inlet openings which are in particular made as elongate inlet bores, with the inlet openings each extending at least substantially parallel to the center axis of the rotor. It has been found that such a fluid inlet for the rotor has a rectifying effect which can noticeably improve the spray pattern. These inlet openings are in particular provided in addition to a rectifier arranged within the rotor.

The inlet openings are preferably arranged on a circle or outside a circle about the center axis of the rotor, with the diameter of the circle being larger than the diameter of a rectifier arranged in the rotor. This positioning of the inlet openings has proved to be particularly advantageous with respect to an improvement of the spray pattern.

In accordance with an independent aspect of a rotor nozzle which can include a flexing device, with this, however, not being compulsory, provision is made that a propellant charge which is arranged upstream of the swirl chamber and via which the fluid flows at least with a radial or tangential component into the swirl chamber can be inserted from the front, in particular via a front assembly opening of the nozzle housing.

In accordance with an independent aspect, the invention relates to a rotor nozzle, in particular for high-pressure cleaning devices, having a nozzle housing which has an inlet opening at its axial one end and an outlet opening at its other end for a fluid, in particular water, as well as having a rotor which is arranged in a swirl chamber of the nozzle housing, which is supported at a bearing at its front end facing the outlet opening, through which the fluid can flow at least partly, which can be set into rotation about a longitudinal axis of the nozzle housing by fluid flowing into the swirl chamber and which is inclined toward the longitudinal axis at least in the rotating state, with the nozzle housing having a front assembly opening through which an assembly including a plurality of components can be introduced into the nozzle housing and can be removed from the nozzle housing as a unit.

An exchange of components such as may be necessary due to wear or to damage-induced failures is hereby made possible which is particularly simple and fast for the user, and indeed independently of the orientation of the rotor nozzle. Reference is also made to the corresponding statements above and below with respect to further advantages and further possible designs of this aspect.

Provision can be made that a flexing device is arranged in the swirl chamber, said flexing device surrounding the rotor and deformation work being carried out at it in a flexing state given from a specific angle of inclination of the rotor onward, with the flexing device adopting a base state up to the specific angle of inclination of the rotor in which the flexing device is arranged at a spacing from the end abutment and with the spacing being changeable in the flexing state by deformation of the flexing device.

Provision can furthermore be made that the assembly includes the rotor, a front closure device through which the front assembly opening can be closed in a fluid-tight manner, the bearing, a flexing device and/or a holding element which holds together at least two further components of the assembly.

The assembly preferably includes the rotor and at least one further component at which the rotor is held non-losably and is simultaneously held pivotable for the change of inclination, with the further component preferably being a flexing element or a holding element.

Provision can be made in this respect that the rotor is held at the further component without additional separate connection means, with a latch connection, snap-in connection, hang-in connection or engagement connection in particular being provided between the rotor and the further component.

This aspect of the invention can be combined with still further features which were explained above, will be described in the following, are shown in the drawings or are set forth in the claims.

Figure 2:
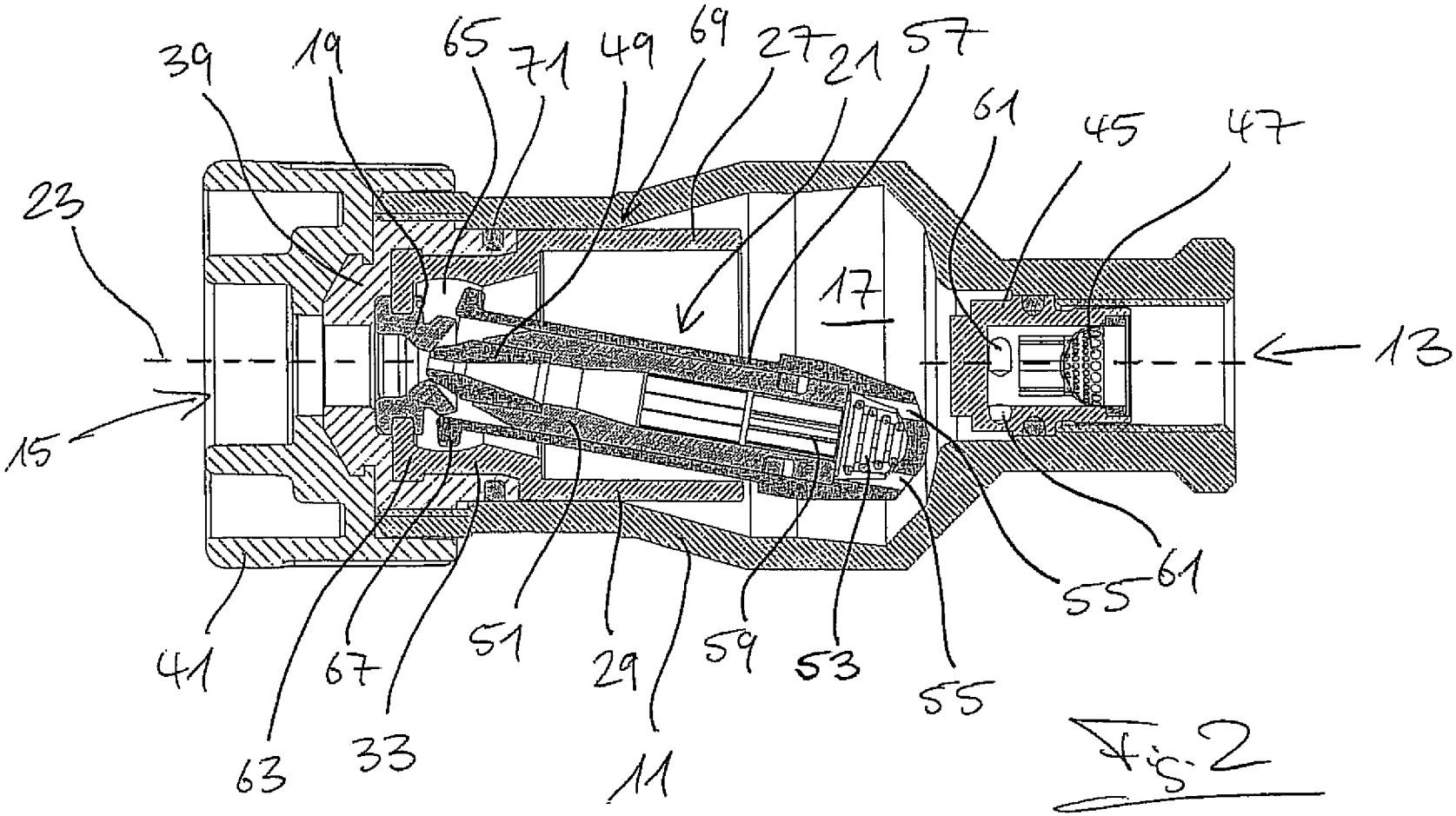
Figure 3:
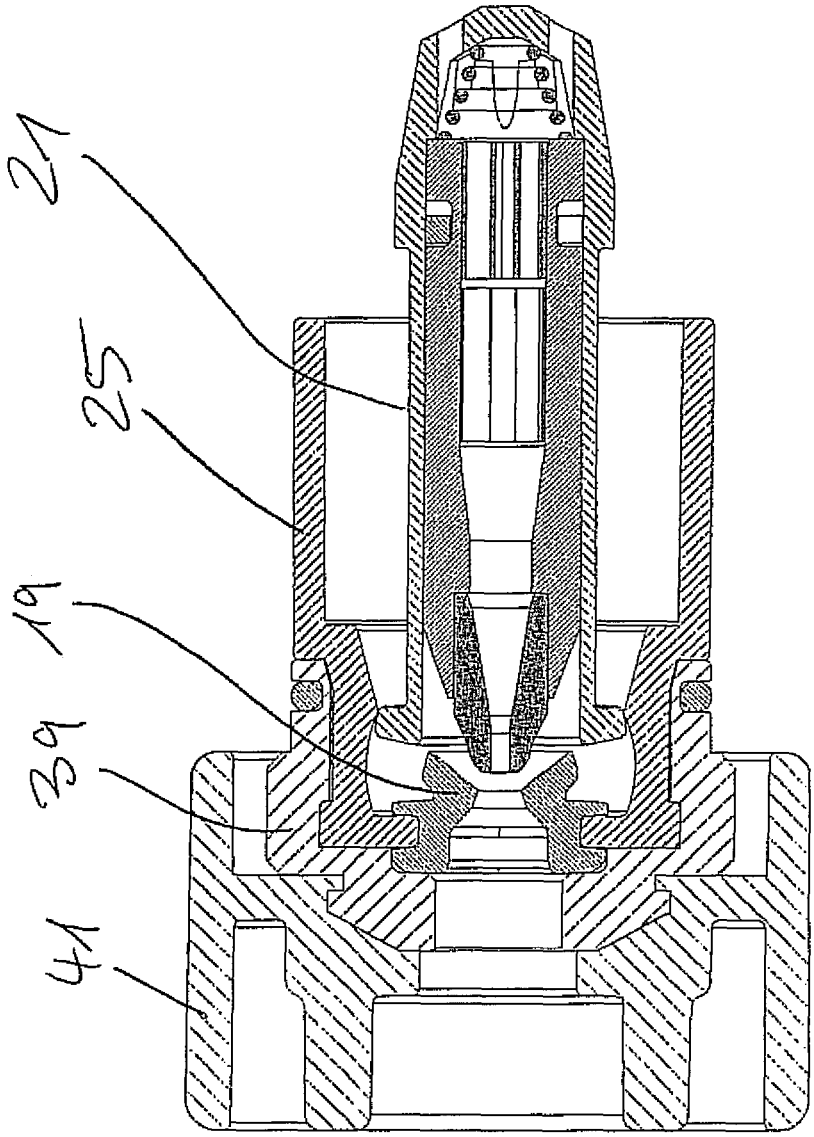
Figure 4:
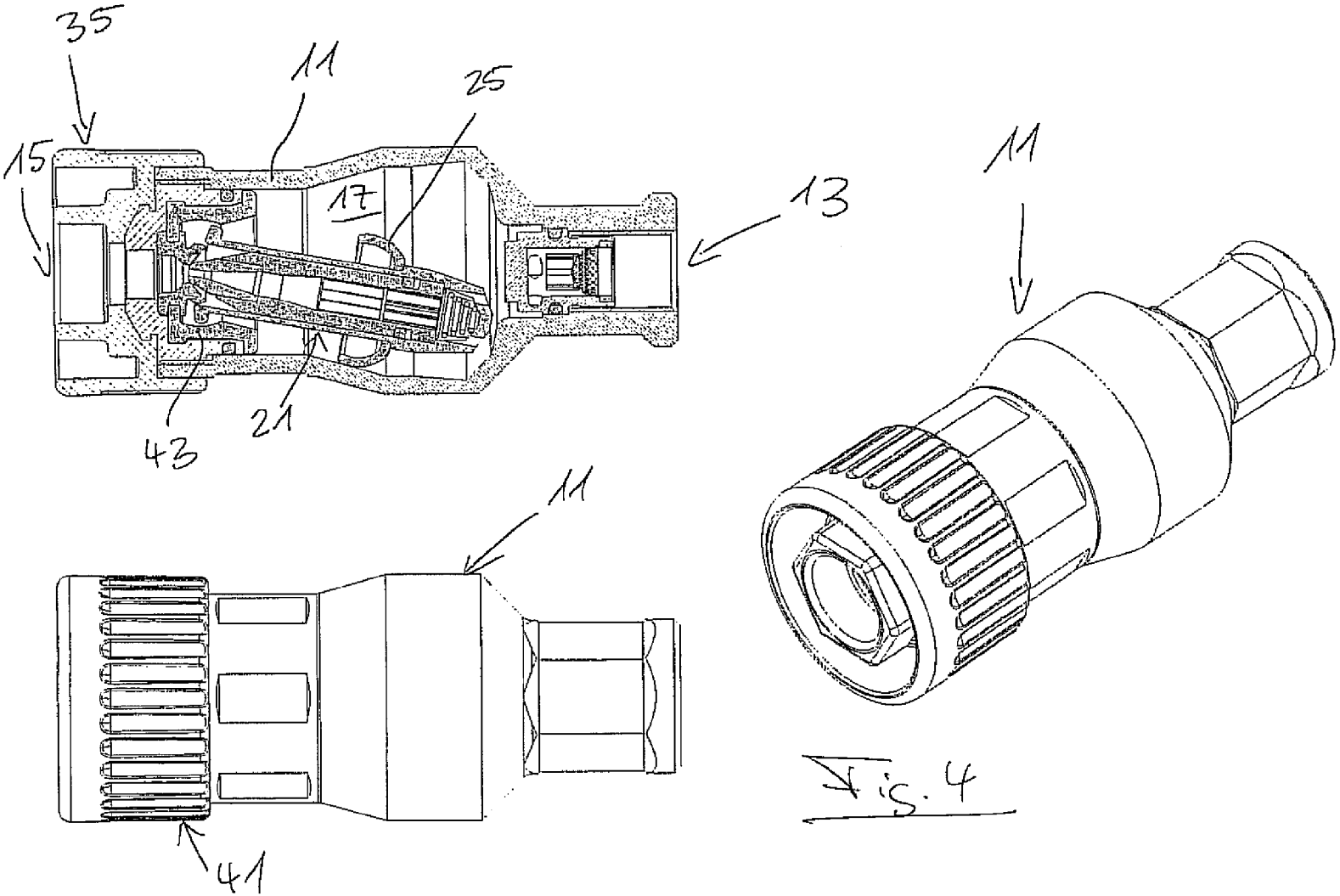
Figure 5:
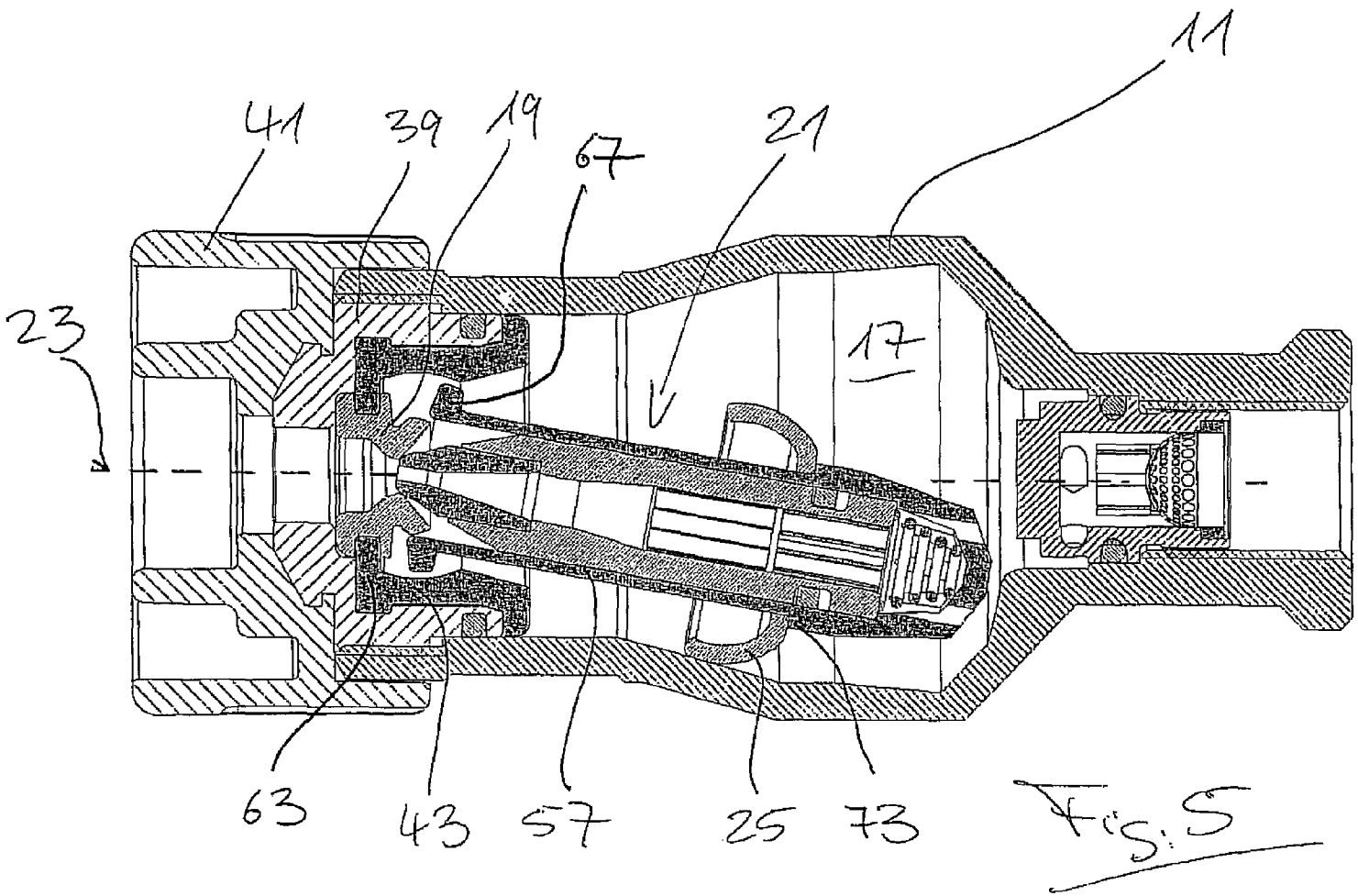

The invention will be described in the following by way of example with reference to the drawing. There are shown:

FIG. 1 different views of a rotor nozzle in accordance with the invention in accordance with a first embodiment;

FIG. 2 a sectional side view of the rotor nozzle of FIG. 1 in an enlarged representation;

FIG. 3 an assembly of the rotor nozzle of FIG. 1 which can be handled as a unit;

FIG. 4 different views of a rotor nozzle in accordance with the invention in accordance with a further embodiment of the invention; and FIG. 5 a sectional side view of the rotor nozzle of FIG. 4 in an enlarged representation.

Only the major components of the rotor nozzle in accordance with the invention are provided with reference numerals in FIG. 1. The design and operation of the rotor nozzle will also be explained in more detail with reference to FIG. 2.

The rotor nozzle in accordance with the invention includes a nozzle housing 11 made of metal. A swirl chamber 17 in which an elongate rotor 21 is arranged is located within the nozzle housing 11. The rotor is supported at its front end formed by a nozzle 49 (FIG. 2) at a pot-shaped bearing 19.

The nozzle housing 11 is open at its front end and is provided with an assembly opening which is closed in a fluid-tight manner by a closure device 35 during operation. The closure device 35 includes a front stopper 39 screwed into the nozzle housing 11 and a handle 41 in the form of a hand wheel which is rotationally fixed to the front stopper 39 so that the user can screw the front stopper into the nozzle housing 11 and unscrew it from the nozzle housing 11 by means of the hand wheel 41.

A flexing device 25 which will be looked at in more detail in the following is connected to the front stopper and to the bearing 19. The rotor 21 is further held non-losably with a flange 67 (FIG. 2) at the flexing device 25, but pivotable relative to the flexing device 25.

The rotor 21, the flexing device 25, the bearing 19, the front stopper 39 and the hand wheel 41 thus form an assembly which can be handled as a unit and which can be screwed to the nozzle housing 11 as a unit.

A propellant charge 45 is arranged in the rear region of the nozzle housing 11 disposed upstream of the swirl chamber 17. Propellant bores 61 (FIG. 2) are formed in this propellant charge 45 and a fluid, in particular water which enters into the rotor nozzle via an inlet opening 13, flows via them into the swirl chamber 17 in the radial or tangential direction in order in this manner to generate a ring flow taking along the rotor 21 in the swirl chamber 17.

The propellant charge 45 is screwed to the nozzle housing 11, with a special feature comprising the fact that the propellant charge 45 can be inserted from the front, that is via the above-mentioned assembly opening of the nozzle housing.

All the components of the rotor nozzle can thus be removed or replaced via the front end of the nozzle housing 11.

The connection of the rotor nozzle in accordance with the invention to a fluid source takes place via the rear end of the nozzle housing 11 which can be screwed to a fluid supply stub, not shown here, or to a fluid supply line.

During operation, the fluid moves via the inlet opening 13 and the propellant bores 61 of the propellant charge 45 into the swirl chamber 17 where it forms a ring flow and hereby allows the rotor 21 to rotate about the longitudinal axis 23 (FIG. 2) of the nozzle housing 11. The fluid moves into the rotor 21 via the inlet openings 55 formed at the rear end region of the rotor 21. The fluid flows through the rotor 21 to the nozzle 49 of the rotor 21 from where it exits the rotor nozzle through the closure device 35, and indeed in the form of a conical jet due to the rotational movement of the rotor 21 about the longitudinal axis 23 of the nozzle housing 11.

A preferred application of this rotor nozzle is a use in car-washes. It is desirable here to be able to replace defective rotor nozzles in as simple and as fast a manner as possible. This is ensured by the explained accessibility of the nozzle housing 11 from the front and by the assembly of rotor 21, flexing device 25, bearing 19 and closure device 35 which can be handled as a unit. The user only needs to unscrew this assembly from the nozzle housing 11 by actuation of the hand wheel 41 and to screw in a new assembly, i.e. the total assembly can be replaced fast and simply as with the replacement of a light bulb.

As can in particular be seen from FIG. 2, the flexing device 25 is a one piece, essentially cylindrical component. The flexing device 25 is preferably made from rubber or from another elastically deformable material.

The flexing device 25 includes a cylindrical flexing section 27 whose center axis coincides with the longitudinal axis 23 of the nozzle housing 17 and which contacts the inner wall of the nozzle housing 11 regionally. Starting from a peripheral edge 69, the nozzle housing 11 widens approximately at the center—seen in the axial direction—of the flexing section 27 toward the rear in the form of a cone so that the flexing section 27 forming the free end of the flexing device 25 is exposed toward the rear—that is upstream—within the swirl chamber 17 and is arranged—seen in the radial direction—spaced from the inner wall of the nozzle housing 11. In this region, the flexing section 27 can therefore be deformed by the rotor 21, namely locally kinked or bent over at the edge 69 when the rotor 21 rotates about the longitudinal axis 23 of the nozzle housing 11 during the rotational operation and in this respect exceeds a specific angle of inclination to the longitudinal axis 24. This angle of inclination, which so-to-say represents the transition between a base state with a non-deformed flexing section 27 and a flexing state at which the rotor 21 carries out deformation work at the flexing section 27, is shown in FIG. 2.

Consequently, a free path distance in the sense of art angle of inclination range of the rotor 21 is available for the deformation of the flexing section 27 due to the spacing in accordance with the invention of the flexing section 27 from the inner wall of the nozzle housing 11. Starting from the cylindrical base state in accordance with FIG. 2, the flexing section 27 can be deflected up to contact at the inner wall of the nozzle housing 11 here extending obliquely to the longitudinal axis 23. The inner wall of the nozzle housing 11 thus forms an end abutment for the flexing device 25 or for its flexing section 27 up to which a deformation path is available. This path distance is in particular larger than the thickness of the flexing section 27, that is than the thickness of the rubber material forming the flexing device 25. The deformation of the flexing section 27 thus does not take place, or only takes place to a very small proportion, by pressing together or compression of the material forming the flexing section 27. The deformation work is rather carried out by a local movement of the material of the flexing device 25 as a whole in the direction of the end abutment.

The assembly section 33 of the flexing device 25 has a smaller diameter than the flexing section 27 and is arranged radially within the front stopper 39. The assembly section 33 satisfies a plurality of functions.

The assembly section 33 thus bounds a pivot space 65 in which the part of the bearing 19 is arranged which cooperates with the nozzle 49 of the rotor 21. A radially projecting flange 67 of the rotor 21 has a diameter which is larger than the inner diameter of the pivot space 65 at its end disposed upstream. The rotor 21 can consequently be pressed beyond this restriction into the pivot space 65 with the flange 67 and can in this manner be latched to the assembly section 33 so that the rotor 21 is held secure against losing at the flexing device 25, with the pivotability of the rotor 21 for the required inclination adjustment being simultaneously ensured.

The inner wall of the assembly section 33 radially bounding the pivot space 65 is at least approximately a part spherical surface whose center is disposed where the tip of the nozzle 49 of the rotor 21 is supported at the bearing 19. A guidance for the pivoting of the rotor 21 hereby takes place at least in a certain framework.

The flexing device 25 is furthermore dimensioned such that it is inserted firmly or with a tight fit into the nozzle housing 11 so that the flexing device 25 itself provides a sealing of the nozzle housing 11. The O ring 71 which is shown in FIG. 2 and which is arranged in a peripheral outer groove of the front stopper 39 is consequently not absolutely necessary to ensure a sufficient sealing of the nozzle housing 11 and could also be omitted.

A flange 63 is furthermore formed at the front end of the assembly section 33 of the flexing section 25 and has a radially inwardly projecting flange section which is in engagement with a peripheral outer groove of the bearing 19 and has a radially outwardly projecting flange section which is in engagement with a peripheral groove of the front stopper 39. The flexing device 25, the bearing 19 and the front stopper 39 are hereby held together.

The rotor 21 includes the already mentioned nozzle 49 which is attached to the front end of a so-called stilt 51 which has a flow passage for the fluid which extends in the axial direction and which opens into the nozzle 49. The stilt 51 is surrounded by a sleeve 57 at whose front end the already mentioned flange 67 is formed with which the sleeve 57 and thus the rotor 21 is held as a whole secure against losing at the assembly section 33 of the flexing device 25.

A spring 53 is arranged in the rear region of the rotor 21 between the stilt 51 and the sleeve 57. Said spring is designed such that it attempts to press the stilt 51 and the sleeve 57 apart in the axial direction. If no fluid flow is present, that is before the start of the rotor nozzle, the rotor 21 is hereby clamped between the bearing 19 and the inner rear wall of the nozzle housing 11 or the end face of the propellant charge 45 facing the swirl chamber 17, so that it is ensured that the nozzle 49 of the rotor 21 securely contacts the bearing 19 on the start of the rotor nozzle. The flow of the fluid through the rotor 21 has the effect that the sleeve 57 is pulled to the front relative to the stilt 51 against the restoring force of the spring 53 so that the biasing of the rotor 21 is cancelled and it can rotate freely. This arrangement consequently provides an optimized starting behavior of the rotor nozzle which should not be looked at in any more detail at this point since this principle is generally known.

A special feature is provided at the rear end of the sleeve 57 with the rotor nozzle shown. A plurality of elongate inlet bores 55 serve as a fluid inlet and extend substantially parallel to the center axis of the rotor 21 and open into a pre-space which is arranged between the sleeve 57 and the rear end of the stilt 51 and in which the spring 53 is arranged. The fluid flowing in via the inlet openings 55 enters via this pre-space into the axial flow passage of the stilt 51 in which a rectifier 59 is arranged.

The inlet openings 55 are arranged on a circle around the center axis of the rotor 21, with the diameter of this circle being larger than the diameter of the rectifier 59. It has been found that this design and arrangement of the fluid inlet formed by the inlet bores 55 results in an improved calming of the fluid flow in the rotor 21 and in a corresponding noticeable improvement of the spray pattern.

The propellant charge 45 which can be inserted into the nozzle housing 11 from the front and can thus also be removed from the front has already been mentioned. The propellant charge 45 is connected to a screen insert 47 at the inlet side.

FIG. 3 shows the mentioned assembly of rotor 21, flexing device 25, bearing 19, front stopper 49 and hand wheel 41 without nozzle housing and propellant charge. This assembly can be unscrewed from the nozzle housing 11 as a whole for the purpose or replacement or repair and can equally be screwed into the nozzle housing 11 as a whole. For this purpose, the user uses the hand wheel 41 to rotate the front stopper 39 which can be screwed to the front end of the nozzle housing. The flexing device 25 is held at the front stopper 39, with the flexing device 25 in turn holding the bearing 19 and the rotor 21 securely against losing.

FIGS. 4 and 5 show a further embodiment of a rotor nozzle in accordance with the invention which differs from the embodiment in accordance with FIGS. 1 to 3 in particular by the design of the flexing device 25 so that only this difference should essentially be looked at here.

The flexing device 25 is made in shell form and is placed onto the sleeve 57 of the rotor 21. A shoulder 73 of the sleeve 57 defines the seat for the flexing device 25.

The shell-shaped flexing device 25 is arranged such that its open end faces to the front. The wall of this "flexing shell" extends approximately parallel to the center axis of the rotor 21 in the region of its opening.

In FIGS. 4 and 5, that position of the rotor 21 is in turn shown in which the rotor 21 is inclined so far that an angle if inclination marking the transition between the base state and the flexing state is given with respect to the longitudinal axis 23 of the nozzle housing 11. The flexing shell 25 is therefore not yet deformed in this position. The path distance available for a deformation of the flexing shell 25, that is the spacing from the inner side of the flexing shell 25 and the end abutment formed here by outer surface of the sleeve 57 of the rotor 21 is therefore not yet completely present in this position. If the angle of inclination of the rotor 21 with respect to the longitudinal axis 23 of the nozzle housing 11 increases, a local deformation of the flexing shell 25 takes place.

Since the flexing device 25 rotates together with the rotor 21 in this embodiment, a holding element 43 is additionally provided which corresponds with respect to its shape at least substantially to the assembly section 33 of the flexing device 25 in accordance with the embodiment of FIGS. 1 to 3.

In the embodiments of FIGS. 4 and 5, it is therefore this holding element 43 which forms a component of the assembly which can be handled as a unit and is held at the front stopper 39 in the manner described in connection with the embodiment of FIGS. 1 to 3 and in turn holds the bearing 19 and the rotor 21 via the front flange 67 of the sleeve 57.

Reference is made in another respect to the embodiment of FIGS. 1 to 3.

It must generally be said that In accordance with the invention the shape and size of the flexing devices 25 can generally be varied as desired in order in this manner to be able to directly preset the running behavior of the rotor 21 and thus the spray pattern of the rotor nozzle. This applies accordingly to the selection of the material of the flexing device 25 and in particular to its properties determining the deformability such as the hardness.

The invention claimed is:

1. A rotor nozzle having a nozzle housing (11) which has an inlet opening (13) at its axial one end and an outlet opening (15) for a fluid at the other end as well as having a rotor (21) which is arranged in a swirl chamber (17) of the nozzle housing (11), which is supported at a bearing (19) at its front end facing the outlet opening (15), which can be at least partly flowed through by the fluid, which can be set into rotation around a longitudinal axis (23) of the nozzle housing (11) by fluid flowing into the swirl chamber (17) and which is inclined toward the longitudinal axis (23) at least in the rotating state, wherein a flexing device (25) is arranged in the swirl chamber (17) and surrounds the rotor (21) and at which deforming work is carried out in a flexing state given from a specific angle of inclination of the rotor (21) onward;

wherein the flexing device (25) adopts a base state up to the specific angle of inclination of the rotor (21) in which the flexing device (25) is arranged at a spacing from an end abutment; and wherein the spacing in the flexing state can be changed by deformation of the flexing device (25).

2. A rotor nozzle in accordance with claim 1, characterized in that the deformation of the flexing device (25) includes a local movement of the material forming the flexing section (25) in the direction of the end abutment, with the amount of the movement being larger than the thickness of the moved material of the flexing device (25).

3. A rotor nozzle in accordance with claim 1, characterized in that the flexing device (25) is made such that the deformation of the flexing device (25) takes place substantially without pressing together or compression of the material of the flexing device (25) due to the spacing from the end abutment.

4. A rotor nozzle in accordance with claim 1, characterized in that the end abutment is formed by the inner wall of the nozzle housing (11).

5. A rotor nozzle in accordance with claim 1, characterized in that the flexing device (25) is arranged in a fixed position with reference to the nozzle housing (11).

6. A rotor nozzle in accordance with claim 1, characterized in that the end abutment is formed by the rotor (21).

7. A rotor nozzle in accordance with claim 1, characterized in that the flexing device (25) is attached to the rotor (21) and can be set into rotation together with the rotor (21).

8. A rotor nozzle in accordance with claim 1, characterized in that a flexing section (27) of the flexing device (25) arranged at a spacing from the end abutment in the base state is made projecting, overhanging, jutting over, protruding and/or sticking out with respect to the nozzle housing (11).

9. A rotor nozzle in accordance with claim 1, characterized in that the flexing device (25) can be deformed by a local bulging, deflection, impression, dimpling, bending, bending over, kinking and/or kinking over.

10. A rotor nozzle in accordance with claim 1, characterized in that the flexing device (25) includes a support region (29) extending in the peripheral direction from which a deformable flexing section (27) of the flexing device (25) starts at which the deformation work is to be carried out and with which the flexing device (25) is in engagement or in contact with the nozzle housing (11) or with the rotor (21).

11. A rotor nozzle in accordance with claim 1, characterized in that the flexing device (25) is made at least in a deformable flexing section (27) at which the deformation work is to be carried out as cylindrical, goblet-shaped, bell-shaped, funnel-shaped, conical or shell-shaped.

12. A rotor nozzle in accordance with claim 1, characterized in that the flexing device (25) extends in the base state at least with a deformable flexing section (27) at which the deformation work is to be carried out at an angle to the longitudinal axis (23) of the nozzle housing or to a center axis of the rotor (21), with the angle preferably being in a range from 0° to 90°.

13. A rotor nozzle in accordance with claim 12, characterized in that the angle with a deformed flexing section (27) is locally increased or decreased with respect to the base state.

14. A rotor nozzle in accordance with claim 1, characterized in that the flexing device (25) includes an assembly section (33) with which the flexing device is attached to the nozzle housing or to the rotor.

15. A rotor nozzle in accordance with claim 1, characterized in that the flexing device (25) is attached in a self-retaining manner to the nozzle housing (11) or to the rotor (21), is in particular inserted into the nozzle housing (11) or is placed onto the rotor (21).

16. A rotor nozzle in accordance with claim 1, characterized in that the flexing device (25) forms, together with at least one further component, an assembly which can be handles as a unit can in particular be inserted into the nozzle housing (11) and/or removed from the nozzle housing (11) as a unit.

17. A rotor nozzle in accordance with claim 16, characterized in that the assembly includes the rotor (21), the bearing (19) and/or a front closure device (35) in addition to the flexing device (25).

18. A rotor nozzle in accordance with claim 1, characterized in that a further assembly opening of the nozzle housing (11) is closed in a fluid-tight manner by a front closure device (35) with the exception of the outlet opening (15).

19. A rotor nozzle in accordance with claim 18, characterized in that the closure device (35) can be actuated in a tool-less manner.

20. A rotor nozzle in accordance with claim 18, characterized in that the closure device (35) includes a front stopper (39) which can be screwed to the nozzle housing (11) with the front stopper (39) preferably being actuable by means of a separate handle (41), in particular a hand wheel, accessible to a user from the outside.

21. A rotor nozzle in accordance with claim 1, characterized in that the bearing (19) for the rotor (21) is formed by a closure device (35) closing a front assembly opening (37) of the nozzle housing (11) or is held by the closure device (35).

22. A rotor nozzle in accordance with claim 17, characterized in that the flexing device (25) holds the closure device (35) and the bearing (19) together.

23. A rotor nozzle in accordance with claim 17, characterized in that the flexing device (25) is held together with the closure device (35), the bearing (19) and/or the rotor (21) by a latch connection, a snap-in connection, a hang-in connection or an engagement connection.

24. A rotor nozzle in accordance with claim 1, characterized in that the rotor (21) is held non-losably at the flexing device (25) and is simultaneously held pivotable for the change in inclination.

25. A rotor nozzle in accordance with claim 1, characterized in that the flexing device (25) is additionally made as a seal.

26. A rotor nozzle in accordance with claim 1, characterized in that the flexing device (25) is made in one piece.

27. A rotor nozzle in accordance with claim 1, characterized in that the flexing device (25) is made as a closed ring at least in a flexing section (27) at which the deformation work is to be carried out.

28. A rotor nozzle in accordance with claim 1, characterized in that the flexing section (27) is provided with openings, throughholes, slits, cut-outs and/or incisions.

29. A rotor nozzle in accordance with claim 1, characterized in that the flexing device (25) is manufactured from an elastically deformable material.

30. A rotor nozzle in accordance with claim 1, characterized in that the flexing device (25) is manufactured from rubber.

31. A rotor nozzle in accordance with claim 1, characterized in that the flexing device (25) is manufactured from a material whose hardness is in the range from 30 to 90 Shore A.

32. A rotor nozzle in accordance with claim 1, characterized in that the rotor (21) has at its rear end a plurality of inlet openings (55) which extend at least substantially parallel to the center axis of the rotor (21).

33. A rotor nozzle in accordance with claim 32, characterized in that the inlet openings (55) lie on a circle or outside a circle about the center axis of the rotor (21), with the diameter of the circle being larger than the diameter of a rectifier (59) arranged in the rotor (21).

34. A rotor nozzle in accordance with claim 1, characterized in that a propellant charge (45) which is arranged upstream of the swirl chamber (17) and via which the fluid flows into the swirl chamber (17) with at least a radial or tangential component can be inserted from the front, in particular via a front assembly opening of the nozzle housing (11).

35. A rotor nozzle having a nozzle housing (11) which has an inlet opening (13) at its axial one end and an outlet opening (15) for a fluid at the other end as well as having a rotor (21) which is arranged in a swirl chamber (17) of the nozzle housing (11), which is supported at a bearing (19) at its front end facing the outlet opening (15), which can be at least partly flowed through by the fluid, which can be set into rotation around a longitudinal axis (23) of the nozzle housing (11) by fluid flowing into the swirl chamber (17) and which is inclined toward the longitudinal axis (23) at least in the rotating state, wherein the nozzle housing (11) has a front assembly opening through which an assembly including a plurality of components can be introduced into the nozzle housing (11) and can be removed from the nozzle housing (11) as a unit, wherein a flexing device (25) is arranged in the swirl chamber (17) which flexing device surrounds the rotor (21) and at which deformation work is carried out in a flexing state given from a specific angle of inclination of the rotor (21) onward, with the flexing device (25) adopting a base state up to the specific angle of inclination of the rotor (21) in which the flexing device (25) is arranged at a spacing from an end abutment and with the spacing being changeable in the flexing state by deformation of the flexing device (25).

36. A rotor nozzle in accordance with claim 35, characterized in that the assembly includes the rotor (21).

37. A rotor nozzle in accordance with claim 35, characterized in that the assembly includes a front closure device (35) by which the front assembly opening can be closed in a fluid-tight manner with the exception of the outlet opening (15).

38. A rotor nozzle in accordance with claim 35, characterized in that the assembly includes the bearing (19).

39. A rotor nozzle in accordance with claim 35, characterized in that the assembly includes a flexing device (25).

40. A rotor nozzle in accordance with claim 35, characterized in that the assembly includes a holding element (43) which holds together at least two further components of the assembly.

41. A rotor nozzle in accordance with claim 35, characterized in that the assembly includes the rotor (21) and at least one further component at which the rotor (21) is held non-losably and is simultaneously held pivotable for the change in inclination, with the further component being a flexing device (25) or a holding element (43).

42. A rotor nozzle in accordance with claim 41, characterized in that the rotor (21) is held at the further component without additional separate connections, with a snap-in connection, a hang-in connection or engagement connection being provided between the rotor (21) and the further component.

* * * * *